United States Patent [19]

Sauer et al.

[11] 4,327,690

[45] May 4, 1982

[54] FUEL INJECTION VALVE

[75] Inventors: Rudolf Sauer, Benningen; Waldemar Hans, Bamberg; Heinrich Knapp, Leonberg, all of Fed. Rep. of Germany

[73] Assignee: Robert Bosch GmbH, Stuttgart, Fed. Rep. of Germany

[21] Appl. No.: 46,295

[22] Filed: Jun. 7, 1979

[30] Foreign Application Priority Data

Jun. 24, 1978 [DE] Fed. Rep. of Germany ..... 2827878

[51] Int. Cl.[3] ..... F02M 55/00; F02B 77/12

[52] U.S. Cl. ..... 123/469; 123/468; 123/198 D

[58] Field of Search ..... 123/139 AW, 32 R, 32 JV, 123/198 D, 469, 468, 470, 471; 251/148, 150; 285/DIG. 19, 302, 351; 277/DIG. 6, 125; 137/92, 798, 799; 239/585, 600

[56] References Cited

U.S. PATENT DOCUMENTS

| | | | |
|---|---|---|---|
| 2,521,127 | 9/1950 | Price | 285/DIG. 19 |
| 2,724,602 | 11/1955 | Carey | 285/351 |
| 2,844,421 | 7/1958 | Hayman | 277/DIG. 6 |
| 3,284,086 | 11/1966 | Primrose | 277/DIG. 6 |
| 3,768,839 | 10/1973 | Thompson | 285/351 |
| 3,776,209 | 12/1973 | Wertheimer | 123/119 R |
| 3,990,730 | 11/1976 | Ekman | 285/351 |
| 4,006,881 | 2/1977 | Gaillard | 277/DIG. 6 |
| 4,157,835 | 6/1979 | Kahle | 277/DIG. 6 |

OTHER PUBLICATIONS

*Diesel Engineering Handbook*, Karl E. Stinson, M.E., 11th Edition, Diesel Publications, Inc., Stamford, Conn., 1963, pp. 108–109.

*Primary Examiner*—Charles J. Myhre
*Assistant Examiner*—Carl Stuart Miller
*Attorney, Agent, or Firm*—Edwin E. Greigg

[57] ABSTRACT

The invention relates to a fuel injection valve having a plug connection to the fuel line, wherein at least two sealing rings are provided between the connection stud and the fuel line nipple in order to obtain emergency sealing capacity.

15 Claims, 7 Drawing Figures

FUEL INJECTION VALVE

BACKGROUND OF THE INVENTION

The invention relates to a fuel injection valve. In known fuel injection valves of the type herein, it has been demonstrated that when there is great stress on one side of the nipple, the sealing ring is severely compressed on one side; thus, at another point, leaks can result. The situations which are most critical, however, are those involving high heat, such as a fire, where the sealing ring is destroyed and fuel, because the connection is no longer tight, flows into the fire.

OBJECT AND SUMMARY OF THE INVENTION

The fuel injection valve of the invention has the advantage over the prior art that even when a ring is crushed or is destroyed, an additional ring effects sealing at least temporarily. In accordance with the construction of the invention, the sealing ring exposed to the air is particularly resistant to heat, since the rings located further inside are already cooled to a greater extent by the fuel.

The invention will be better understood as well as further objects and advantages thereof become more apparent from the ensuing detailed description of preferred embodiments taken in conjunction with the drawings.

DESCRIPTION OF THE PREFERRED EMBODIMENTS

Figure 1:
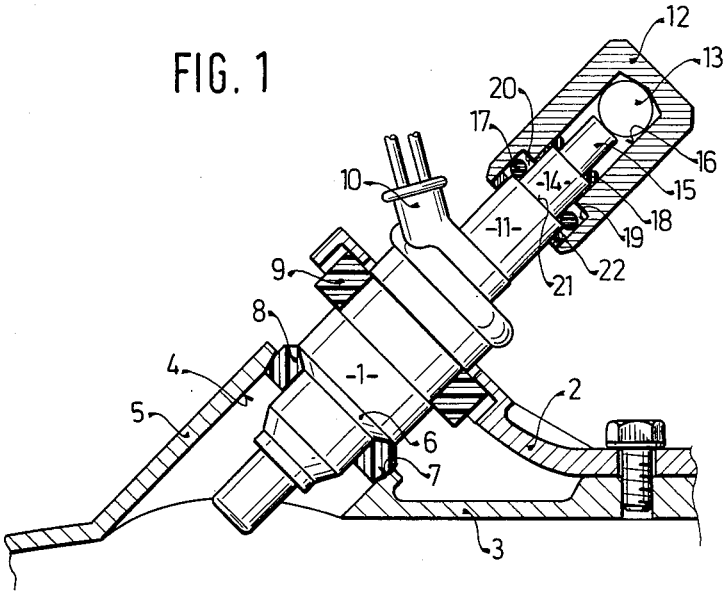
FIG. 1 is a side elevation view, partially in section, of a fuel injection valve incorporating one embodiment of the invention.

Referring now to FIG. 1, a magnetic valve 1 is secured by a clamp 2 to an intake manifold 3. The valve protrudes with its injection end into the opening 4 of a tubular stud 5 of the intake manifold 3. Between a shoulder 6 of the magnetic valve 1 and a shoulder 7 of the tubular stud 5, there is an elastic sealing ring 8.

The clamp 2 grips the magnetic valve 1 via an elastic ring 9 connected in a force-locking manner with the magnetic valve. The magnetic valve 1 is provided with an electrical connection 10 and a fuel connection stud 11. A plug nipple 12 is placed in a sheath-like fashion over this connection stud 11 and is connected with a fuel pressure line 13, not shown in further detail. The type of fastening between the nipple 12 and the magnetic valve 1 is also not shown in further detail.

The connection stud 11 has two recessed portions of reduced diameter or steps 14 and 15, over which the nipple 12 with its inner bore 16 is placed. Between the nipple 12 and the steps 14, 15 of the connection stud 11 there are two sealing rings 17, 18, with the sealing ring 18 being arranged to provide a seal between the step 15 and the inner bore 16, and the sealing ring 17 being located between the step 14 and an enlarged portion 19 of the bore 16. The shoulder 20 formed between the enlarged portion 19 and the bore 16 can serve, together with a shoulder 21 formed between the step 14 and the stud 11, as a stop via the sealing ring 17 when the nipple 12 is placed thereon.

In addition to the two sealing rings 17 and 18, a heat-resistant ring 22 can be disposed between the enlarged portion 19 and the stud 11, toward the air. Preferably, the ring 22 oriented toward the air is selected to be heat-resistant and/or ozone-resistant, while the ring oriented toward the fuel should exhibit the primary sealing capability.

In FIGS. 2–7, only the plug connection 11 of the fuel injection valve 1 is shown, on a larger scale than that of the valve of FIG. 1.

Figure 2:
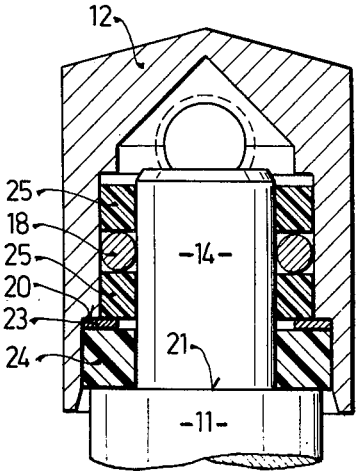
FIG. 2 is an enlarged view, partially in section, of a portion of the valve of FIG. 1 illustrating a second embodiment of the invention.

As may be seen in FIG. 2, a hard disc 23 is supported on the shoulder 20 of the plug nipple 12 and acts in the axial direction toward the magnetic valve 1 on a stuffing-box ring 24. This stuffing-box ring 24 is supported on the opposite side on the shoulder 21 and guided on the inside and the outside, respectively, by the pressure connection stud 11 and the plug nipple 12, respectively.

It is a precondition that the plug nipple 12 be stressed in the direction of the magnetic valve 1. Such a stuffing-box ring 24 may be of asbestos or graphite, and such material is known to be capable of resisting a continuous temperature of 600° C. One of the conventional requirements placed on such stuffing-box rings is that they be contacted on all sides and that they be under compression stress at least in one direction. In this connection, attention must be paid to the fact that the stuffing-box ring 24 expands at a higher temperature than, for example, the temperature occurring upon the breaking out of fire, and thus undergoes radial compression.

Figure 5:
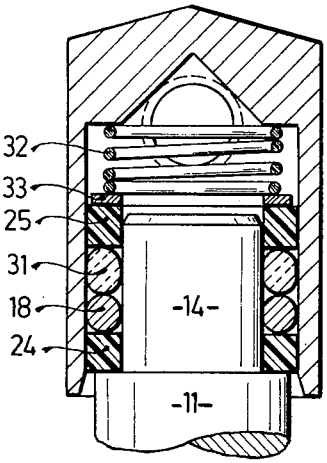
FIG. 5 is an enlarged view, partially in section, of a portion of the valve of FIG. 1 illustrating a fifth embodiment of the invention.

In the embodiment of FIG. 2, as in the embodiment of FIG. 5, the connection stud 11 is stepped or recessed only once. On this step 14, there is, in addition to the stuffing-box ring 24, an O-ring 18 between two guide rings 25. While the O-ring 18, which may be, for example, of Viton, assumes the actual sealing function, the guide rings 25 substantially provide emergency sealing capacity. These guide rings 25, which may also be molded rings, may be of a plastic such as polyamide, while the ring 25 adjacent to the stuffing-box ring 24 may be of a plastic which melts comparatively easily, so that, in case sufficient heat builds up, it can flow into the fissures which may appear between the stuffing-box ring 24 or the O-ring 18 and their radial restricting walls.

Figure 3:
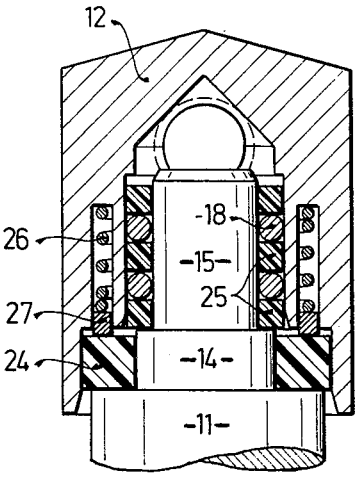
FIG. 3 is an enlarged view, partially in section, of a portion of the valve of FIG. 1 illustrating a third embodiment of the invention.

In the third embodiment of FIG. 3, the pressure connection stud 11 again has two recessed steps 14 and 15. While O-rings 18 and guide rings 25 are disposed about the step 15, the stuffing-box ring 24 is disposed about the step 14. The stuffing-box ring 24 is thus separated from the rest of the sealing-ring packet. A compression spring 27, stressed by a spring 26, presses onto the stuffing-box ring 24 in the axial direction.

Figure 4:
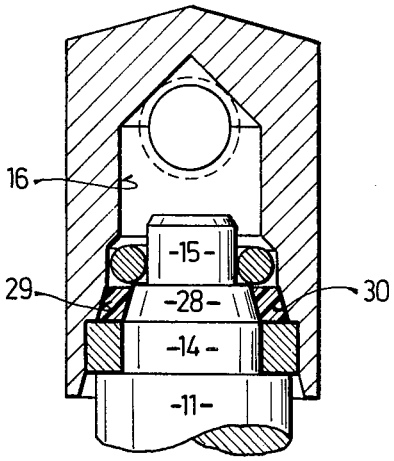
FIG. 4 is an enlarged view, partially in section, of a portion of the valve of FIG. 1 illustrating a fourth embodiment of the invention.

In the fourth embodiment of FIG. 4, a conical shoulder 28 is disposed between the recessed steps 14 and 15 of the connection stud 11 and the bore 16 of the plug nipple 12 is provided with a corresponding shoulder 29 opposite the shoulder 28. Between the shoulders 28 and 29 there is a rhomboid ring 30, which can accept radial and axial forces. In addition, this ring 30 can be made of a highly temperature-resistant material.

In the fifth embodiment of FIG. 5, there are disposed on the step 14 of the pressure connection stud 11, besides a stuffing-box ring 24, an O-ring 18 and a melting ring 25, an asbestos cord ring 31, which may be enclosed by soft metal or wound around with Teflon yarn. The entire ring packet, in which the abestos cord ring 31 is disposed between the O-ring 18 and the melting ring 25 is compressed by a spring 32, which acts via an interposed disc 33 directly on the melting ring 25. This accomplishes two things: first, the stuffing-box ring 24 is stressed in the desired manner, and second, when there is sufficient heat and the melting ring 25 melts, its fluid mass is pressed into the asbestos cord ring 31. The hard ring 33 thereby acts in the manner of a piston.

Figure 6:
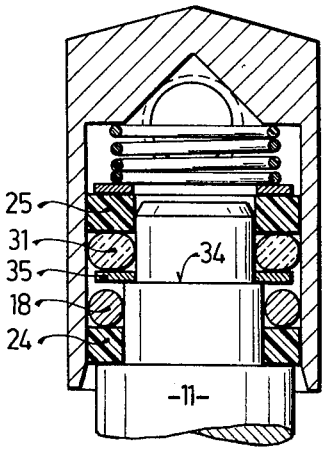
FIG. 6 is an enlarged view, partially in section, of a portion of the valve of FIG. 1 illustrating a sixth embodiment of the invention.

In the sixth embodiment of FIG. 6, the stuffing-box ring 24 and the O-ring 18 are uncoupled from the asbestos cord ring 31 and the melting ring 25 by a hard ring 35 supported on a shoulder 34.

Figure 7:
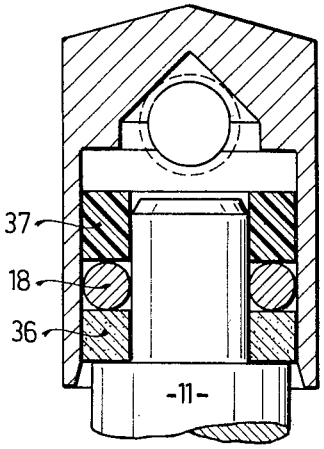
FIG. 7 is an enlarged view, partially in section, of a portion of the valve of FIG. 1 illustrating a seventh embodiment of the invention.

In the seventh embodiment shown in FIG. 7, the sealing packet, viewed from the air side inward, comprises a graphite ring 36, the O-ring 18 and a ring 37 of plastic, which can be provided with an asbestos filling. In case of fire, the graphite ring 36 serves as emergency sealing. If the O-ring 18 fails, the escape of fuel through the graphite ring 36 cannot be entirely prevented; however, a forceful ejection of fuel is prevented.

The asbestos-filled plastic of the ring 37 melts at a temperature which is just below the temperature which destroys the O-ring 18 so that asbestos fibers are pressed, together with the less and less viscous melting mass, into gaps which may form or may exist between the graphite ring 36 or the O-ring 18 and the sealing surfaces of the nipple 12 or the valve 1. As a result, even small leaks are stopped.

The decisive factor in the invention is that as a result of at least a second additional ring, emergency sealing capacity is obtained, particularly for high temperatures.

The foregoing relates to preferred embodiments of the invention, it being understood that other embodiments and variants thereof are possible within the spirit and scope of the invention, the latter being defined by the appended claims.

What is claimed and desired to be secured by Letters Patent of the United States is:

1. A fuel injection valve such as a magnetic valve, comprising in combination, a valve body having a pressure connection stud, a fuel line plug nipple adapted to be fitted onto said connection stud, a first elastic sealing ring disposed between said nipple and said stud, at least one other sealing ring disposed adjacent to said first elastic sealing ring between said nipple and said stud, and a heat-resistant stuffing box ring exposed on one side to surrounding air disposed between said stud and said nipple, said stuffing box ring serving to seal said nipple and said stud axially as well as annularly, said other sealing ring possessing a melt temperature below that of said elastic sealing ring, whereby emergency sealing can be effected upon meltdown of said other sealing ring.

2. A fuel injection valve in accordance with claim 1, including at least one of a guide ring and an intermediate ring disposed on said connection stud adjacent to said sealing rings.

3. A fuel injection valve in accordance with claim 2, including a ring containing asbestos, such as an asbestos cord ring or a plastic ring with asbestos filling material, is disposed on said connection stud.

4. A fuel injection valve in accordance with claim 3, wherein said asbestos cord ring is enclosed by soft metal or is wound around with Teflon yarn.

5. A fuel injection valve in accordance with claim 2, wherein said connection stud is provided with a step shoulder and said heat-resistant ring is an axially stressed stuffing-box ring axially supported on said connection stud and seals against said step shoulder toward the air side.

6. A fuel injection valve in accordance with claim 5, including at least one intermediate ring and a spring supported within the plug nipple for stressing said stuffing-box ring on the side remote from said step shoulder via said at least one intermediate ring.

7. A fuel injection valve in accordance with claim 6, including an easily melting plastic ring, as a safety means, disposed adjacent to at least one of said asbestos cord rings or said stuffing box ring.

8. A fuel injection valve in accordance with claim 7, including a melting ring and a spring-stressed hard ring which acts in the manner of a piston on the melting ring in the direction of at least one of said asbestos cord rings and said stuffing-box ring.

9. A fuel injection valve in accordance with claim 1, including a graphite ring, an O-ring and a ring containing asbestos are disposed in sequence as viewed from the air side inward.

10. A fuel injection valve in accordance with claim 9, wherein said O-ring is made of Viton.

11. A fuel injection valve in accordance with claim 9, wherein the asbestos is the filling material of a plastic for said asbestos ring which only melts at a higher temperature.

12. A fuel injection valve in accordance with claim 9, wherein said rings are disposed in axially adjacent relationship on said connection stud.

13. A fuel injection valve in accordance with claim 12, wherein said connection stud is provided with a shoulder and including a hard guide ring interposed between said rings and supported on said shoulder for separating said rings thereby permitting at least some of said rings to be decoupled from one another axially.

14. A fuel injection valve in accordance with claim 1, wherein said plug nipple is provided with a bore and wherein said connection stud and said nipple bore are provided with conical ring surfaces opposite one another and a ring having a rhomboid cross section disposed between said conical ring surfaces for accepting radial and axial forces.

15. A fuel injection valve in accordance with claim 14, wherein said rhomboid-shaped ring is made of heat-resistant material.

* * * * *